US007494202B2

(12) United States Patent
Sato

(10) Patent No.: US 7,494,202 B2
(45) Date of Patent: Feb. 24, 2009

(54) IMAGE FORMING APPARATUS AND A SUB-LINE CONTROL SECTION FOR AN IMAGE FORMING APPARATUS

(75) Inventor: Toshiki Sato, Tokyo (JP)

(73) Assignee: Oki Data Corporation, Tokyo (JP)

( * ) Notice: Subject to any disclaimer, the term of this patent is extended or adjusted under 35 U.S.C. 154(b) by 265 days.

(21) Appl. No.: 10/994,462

(22) Filed: Nov. 23, 2004

(65) Prior Publication Data

US 2005/0110861 A1 May 26, 2005

(30) Foreign Application Priority Data

Nov. 26, 2003 (JP) ..... 2003-395783

(51) Int. Cl.
*B41J 29/38* (2006.01)
*B41J 2/395* (2006.01)
*B41J 2/47* (2006.01)

(52) U.S. Cl. ..... 347/11; 347/9; 347/130; 347/131; 347/237

(58) Field of Classification Search ..... 347/9, 347/11, 130, 131, 237
See application file for complete search history.

(56) References Cited

U.S. PATENT DOCUMENTS 5,648,810 A * 7/1997 Tanuma et al. ..... 347/130
5,809,216 A * 9/1998 Ng ..... 358/1.9

FOREIGN PATENT DOCUMENTS

JP 05-199385 8/1993
JP 11-291550 10/1999

* cited by examiner

*Primary Examiner*—K. Feggins
*Assistant Examiner*—Jannelle M Lebron
(74) *Attorney, Agent, or Firm*—Rabin & Berdo, PC

(57) ABSTRACT

What is disclosed is an image forming apparatus to form each of lines formed with different sizes of dots, comprising: a print control section to control printing by providing elements for printing, with a pulse current, so as to form each of said dots; a correcting circuit to correct magnitude of said pulse current at said each of lines printed with different sizes of dots.

19 Claims, 8 Drawing Sheets

2
6
7
CHANGING CIRCUIT
VDD
8
9
D
S
Q
|Q
DB7
DB6
DB5
DB4
DB3
DB2
DB1
DB0
Vref
TO LED HEAD 3
LOAD
STB
DA CONVERTOR
SYNCHRONIZING SIGNAL FSYNC
LOAD SIGNAL LOAD
STROBE SIGNAL STB

IMAGE FORMING APPARATUS AND A SUB-LINE CONTROL SECTION FOR AN IMAGE FORMING APPARATUS

BACKGROUND OF THE INVENTION

1. Field of the Invention

The present invention relates to an image forming apparatus and a sub-line control section for an image forming apparatus, which drive elements of emitting light or emitting heat in order to form images or to print data.

2. Description of Related Art

In general, an image forming apparatus such as a printer prints each line. And, each line includes plural dots. For example, an LED printer prints each line with an LED head, which comprises plural elements of LED's arrayed in a line. Meanwhile, in order to increase resolution of an image formed or printed, a method called smoothing is adopted. This is a method of printing a sub-line between each of main lines, so as to compensate for space between main lines. In order to smooth lines, that is, slanted lines in an image, it is necessary to form dots in sub-lines smaller than dots in main lines. Therefore, it is necessary to make energy for emitting light at sub-lines less than energy for emitting light at main lines.

Said elements for emitting light, emit light with energy which is generally proportional to product of magnitude and time, of a pulse current given to the elements for emitting light. And, in conventional art, the magnitude of a pulse current is fixed. Therefore, the time of a pulse current, that is, pulse width of a current is changed as a place to light is changed to a main line or to a sub-line, so as to change magnitudes of dots at a main line or at a sub-line (c.f. JP11-291550).

However, in the conventional printer mentioned above, there was a following problem. A pulse current needs a certain length of time to ascend or to descend. And, the time to ascend or to descend, influences the elements for emitting light. That is, the elements do not emit light until the pulse current ascends to a stable level. And, the elements become unstable while the pulse current descends. Therefore, when printing is performed in a high speed, dots in each line become unstably printed. And, each of dots are printed with different magnitudes. As a result, quality of printing decreases.

SUMMARY OF THE INVENTION

The present invention was made to solve a problem mentioned above, by adopting following configuration.

According to one aspect of the present invention, there is provided an image forming apparatus for forming images by driving elements along lines located corresponding to data, comprising: a main line located as a first line or as a second line among said lines, a sub-line located between said first line and said second line, and a control section for controlling a current provided to said driving elements to change the current at said main line or at sub-line.

According to another aspect of the present invention, there is provided an image forming apparatus for forming images on media by an optical head having plural light emitting elements arrayed in a line, comprising: an optical head having plural light emitting elements arrayed in a line, a medium moving in a direction perpendicular to the line of said light emitting elements, and a current control section for changing periodically a current provided to said light emitting elements corresponding to the movement of said medium.

According to the other aspect of the present invention, there is provided an image forming apparatus to form each of lines formed with each size of dots, comprising: a print control section to control printing by providing elements for printing, with a current, so as to form each of said dots; a sub-line control section to correct magnitude of said current at said each of lines printed with different sizes of dots.

According to the other aspect of the present invention, there is provided a sub-line control section for an image forming apparatus comprising: a changing circuit to change digital values according to a load signal from a print control section of an image forming apparatus; a DA convertor to convert said digital value to an analog value for deciding a magnitude of a current provided to elements for printing.

DESCRIPTION OF THE PREFERRED EMBODIMENTS

A printer provided with a light emitting element driver of Embodiments according to present invention, will be described.

Embodiment 1

<Configuration>

Before describing a printer of Embodiment 1, what is a smoothing for obtaining a high resolution performed by a printer of Embodiment 1, is described.

Figure 2:
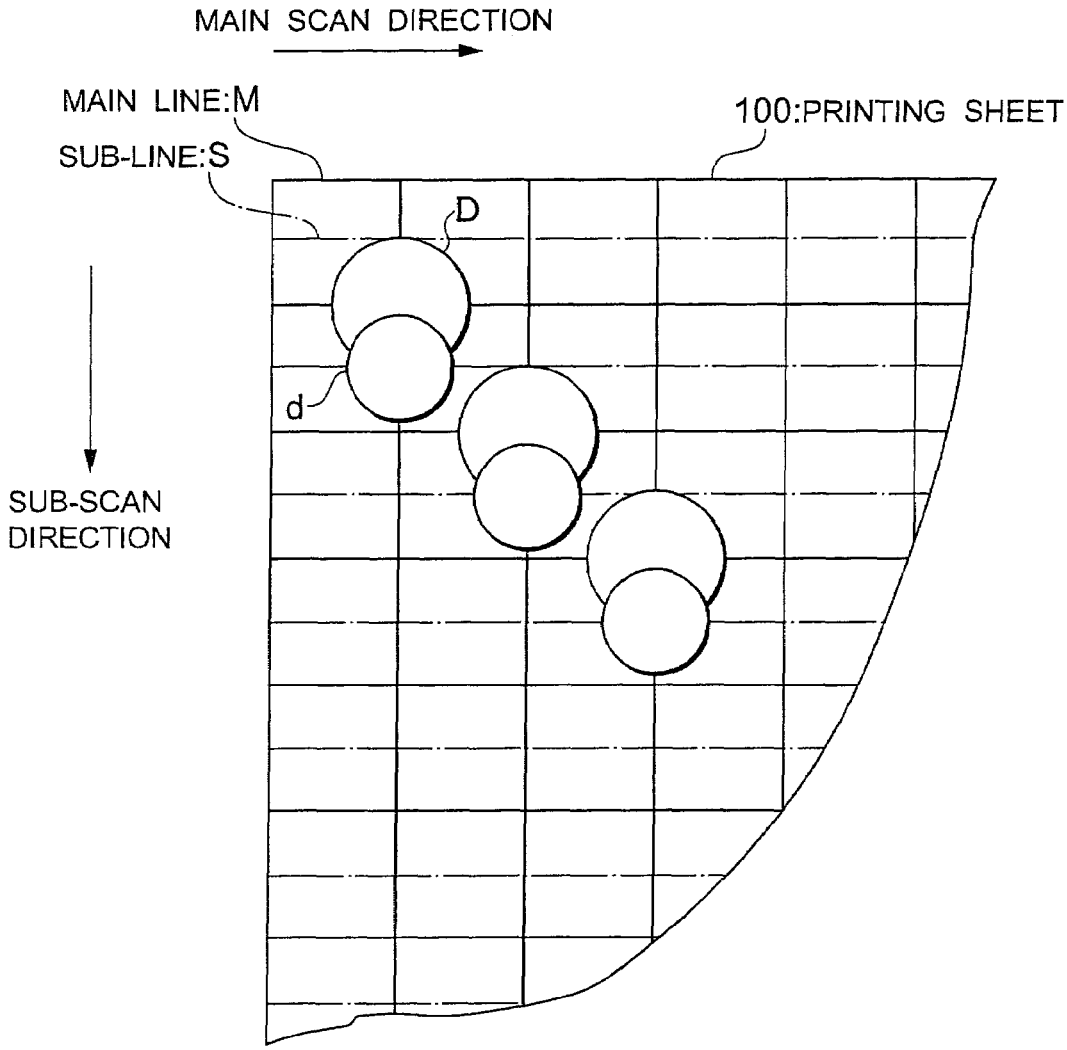
FIG. 2 is showing a part of a printed sheet with a slanted line smoothed by a method of Embodiment 1.

FIG. 2 is showing a part of a printed sheet with a slanted line smoothed by a method of Embodiment 1. A printer of Embodiment 1 is an LED printer hitherto known well. An array of plural LED elements are provided at a place where the LED elements are fixed across passage of printing sheet, so as to perform main scan in direction across the printing sheet as shown in FIG. 2. The printer of Embodiment 1 performs a smoothing in direction vertical to the direction of main scan mentioned above. That is, the direction of smoothing, is a direction of conveying a printing sheet 100. And, it is a direction of performing sub-scan in direction along a passage of printing sheet. To be more concrete, the printer of Embodiment 1, performs printing of each sub-line S between each of neighboring main lines M as shown in FIG. 2. Then, each sub-line S repairs a slanted line consisted of each main line M. Here, each main line M is a line of printing performed in a direction parallel with the direction of main scan mentioned above.

A motor not shown in the drawings is provided in order to send the printing sheet 100. Thus, the printing sheet 100 proceeds along a conveyance path by conveying rollers driven by the motor, which send the printing sheet 100 to the LED elements along a sub-scan direction in FIG. 2, with each interval of a prescribed length per a unit time, under a control of a print control section 1 in FIG. 1. And, the LED elements arrayed in a main scan direction in FIG. 2 emit light at each main line M with a dot D and sub-line S with dot d.

In FIG. 2, each main line M is shown by a thick line which is parallel with the direction of main scan. On the other hand, each sub-line S is shown by a dot line which is parallel with the direction of main scan as well. In FIG. 2, each dot D printed on a main line M, is shown. And, each dot d printed on a sub-line S, is shown. Each dot d on a sub-line S is smaller than each dot D on a main line M, because each sub-line is printed for repairing a slanted line made up of each dot D. Therefore, it is necessary to make energy for emitting light of LED element for forming each dot d on a sub-line S, to be smaller than energy for forming each dot D on a main line M.

Figure 1:
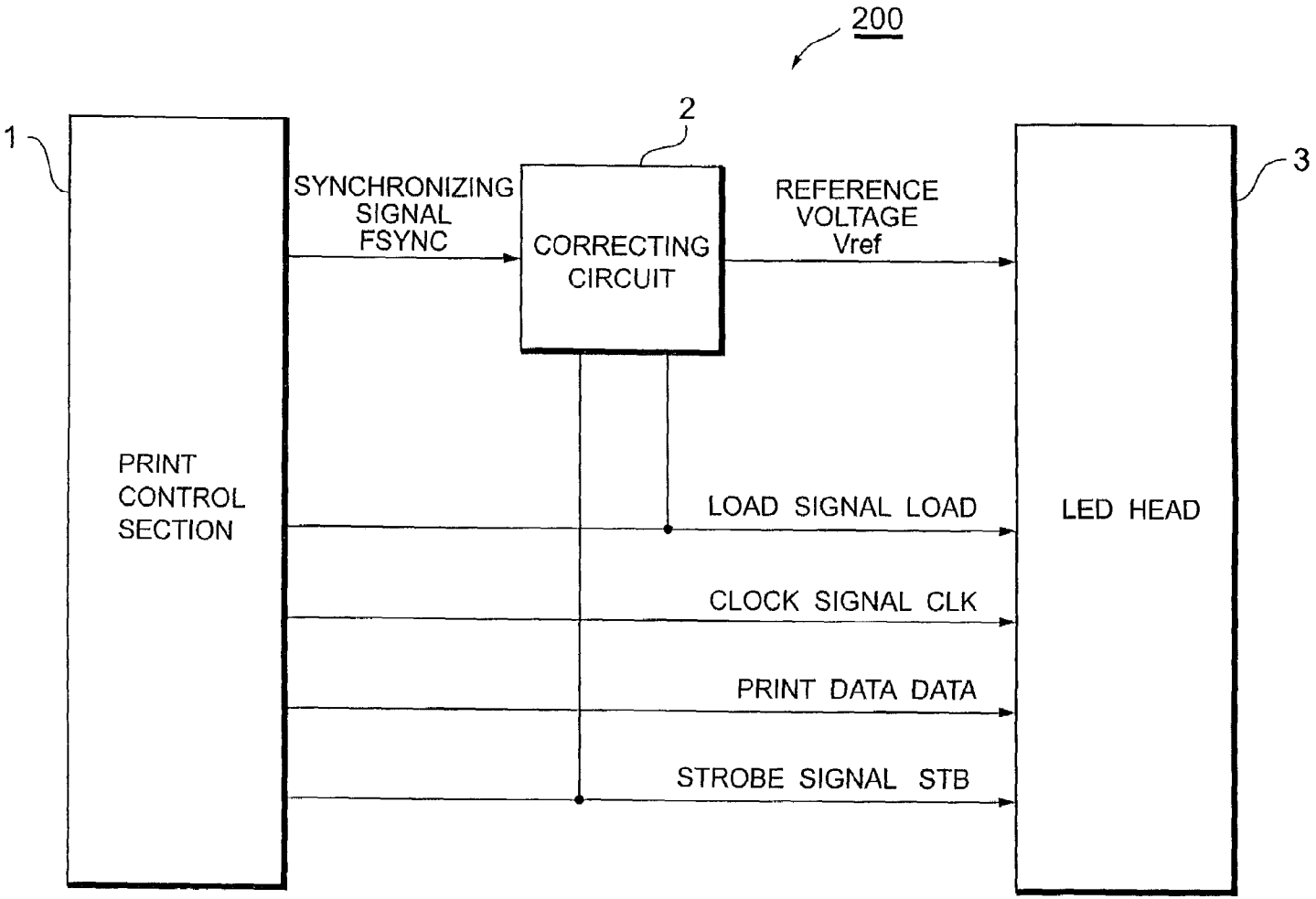
FIG. 1 is a block diagram showing a structure of Embodiment 1.

FIG. 1 is a block diagram showing a structure of Embodiment 1. A printer 200 of Embodiment 1, comprises a print control section 1 for controlling an LED head 3, and a correcting circuit (sub-line control section) 2 performing a process necessary for said LED head 3 to print said main line M and sub-line S.

The print control section 1 comprises, for example, a CPU, ROM, RAM, clock generator etc. hitherto known well. And, the print control section 1 puts out a clock signal CLK, a print data DATA, a load signal LOAD and a strobe signal STB, to said LED head 3. The clock signal CLK is a signal to decide timing of printing operation of said LED head 3. The print data DATA is a data of image to be printed by said LED head 3. The load signal LOAD is a signal for controlling timing of holding said print data DATA in a driver circuit of said LED head 3.

Moreover, the strobe signal STB is a signal to decide starting and ending of emitting light from said LED head 3. The strobe signal STB does not contribute to a control of quantity of light emitted from said LED head 3. That is, the strobe signal STB is always put out with same width of pulse, whether any line to be printed is a main line M or a sub-line S. And, every width of the strobe signal STB is set to a minimum width obtained with high precision.

The print control section 1 puts out a synchronizing signal FSYNC to said correcting circuit 2. The synchronizing signal FSYNC synchronizes printing operation in a direction of sub-scan.

The correcting circuit (sub-line control section) 2 generates a reference voltage Vref, with using said synchronizing signal FSYNC, load signal LOAD and strobe signal STB, which are put out from said print control section 1 respectively. And, the correcting circuit 2 puts out the reference voltage Vref to said LED head 3.

In the printer of Embodiment 1, each quantity of light emitted from LED element in said LED head 3 is decided by drive current mentioned later, which is decided by said reference voltage Vref generated by said correcting circuit 2. Therefore, area of dot D or dot d on the main line M or sub-line S, is originally decided by said reference voltage Vref. An example of configuration of the correcting circuit 2 will be described later, referring to FIG. 4. Before this, an example of configuration of the LED head 3 will be described, because the correcting circuit 2 is provided for this LED head 3.

The LED head 3 casts a light on surface of photosensitive drum, so as to print an image specified by the print data DATA put out from said print control section 1, onto a print sheet 100 shown in FIG. 2, with using said clock signal CLK, load signal LOAD and strobe signal STB put out from said print control section 1.

Figure 3:
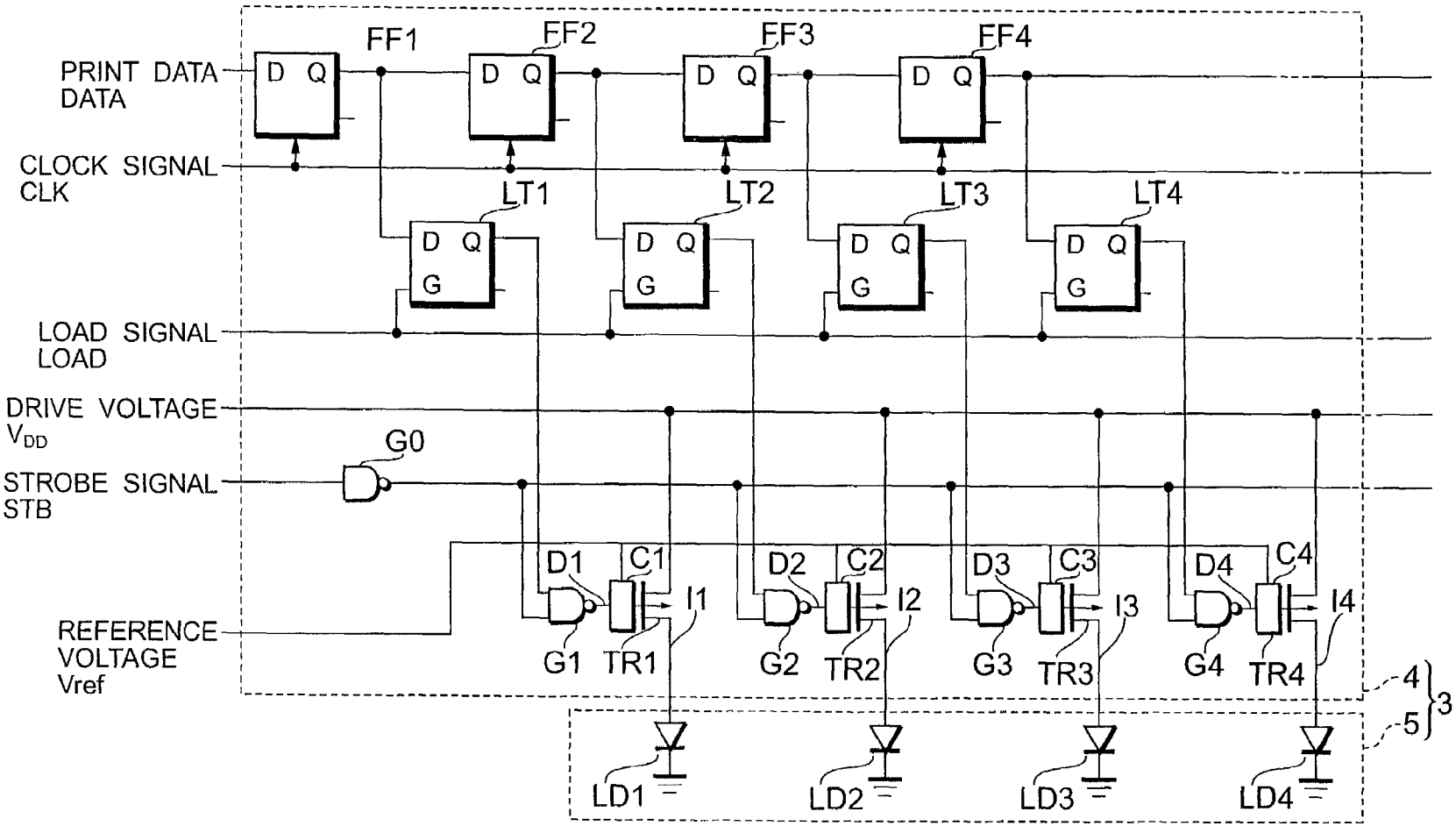
FIG. 3 is a circuit diagram showing a structure of an LED head.

FIG. 3 is a circuit diagram showing an example of configuration of an LED head. An LED head 3 in FIG. 3 comprises a driver IC chip 4 for driving plural LED LD1 to LD 4, and an LED chip 5 comprising plural LED LD1 to LD 4 connected with the driver IC chip 4 in parallel. Thus, a set of a driver IC chip 4 and an LED chip 5 is shown in FIG. 3.

The driver IC chip 4 is inputted with said print data DATA, said clock signal CLK, said load signal LOAD and said strobe signal STB from said print control section 1, as shown in FIG. 3. Moreover, the driver IC circuit 4 is inputted with said reference voltage Vref from said correcting circuit 2, which will be described in detail, later. And, the driver IC chip 4 puts out drive currents I1 to I4, to said LED chip 5.

For this relation of input and output, the driver IC chip 4 comprises plural flip-flop circuits FF1 to FF4 connected in series, plural latch circuits LT1 to LT4, a buffer circuit G0, and plural sets of gate circuit G1 to G4, current variable circuit C1 to C4 and transistor TR1 to TR4.

A first flip-flop circuit FF1 is inputted with said print data DATA at an input terminal D. A second flip-flop circuit FF2 is inputted with a signal put out from an output terminal Q of said first flip-flop circuit FF1. Similarly, a third flip-flop circuit FF3 is inputted with a signal put out from an output terminal Q of said second flip-flop circuit FF2. And, a fourth flip-flop circuit FF4 is inputted with a signal put out from an output terminal Q of said third flip-flop circuit FF3.

Thereby, said plural flip-flop circuits FF1 to FF4 comprise a shift resistor.

Moreover, each of said plural flip-flop circuits FF1 to FF4 are inputted with said clock signal CLK at each of clock terminals of said plural flip-flop circuits FF1 to FF4.

Therefore, said print data DATA inputted with the first flip-flop circuit FF1, is sent to succeeding flip-flop circuit FF2 to FF4 in order, according to timing of said clock signal CLK.

Each input terminal D of plural latch circuits LT1 to LT4 are inputted with each of corresponding output signal put out from output terminal Q of flip-flop circuit FF1 to FF4. And, each of said plural latch circuits LT1 to LT4 are inputted with said load signal LOAD at each of gate terminals of said plural latch circuits LT1 to LT4. On the other hand, each output terminal Q of plural latch circuits LT1 to LT4 are connected with each one of input terminals of corresponding gate circuit G1 to G4.

Therefore, each of said plural latch circuits LT1 to LT4 latch each data of plural flip-flop circuits FF1 to FF4, at a timing decided by the load signal LOAD, so as to put out said print data DATA to each gate circuit G1 to G4.

A buffer circuit G0 inverts a strobe signal STB given from said print control section 1, so as to give it to other of input terminals of corresponding gate circuit G1 to G4.

Each of gate circuits G1 to G4 performs NAND logic calculation between each output signal Q of said latch circuits LT1 to LT4 and a strobe signal of said buffer circuit G0. And, a result of calculation is put out to each of current varying circuits C1 to C4. The result of calculation is a signal D1 to D4 deciding time for flowing drive current I1 to I4 of said LED elements in a LED chip 5.

The current varying circuit C1 to C4 and transistor TR1 to TR4 of FET comprise, for example, current mirror circuits, which are hitherto known well. The current mirror circuits put out drive currents I1 to I4 decided by said reference voltage Vref given by said correcting circuit 2, to LED chip 5; while said signals D1 to D4 for deciding time to flow currents, are put out.

On the LED chip 5, plural LED elements LD1 to LD4 are arrayed in a line. And, each cathode of LED elements LD1 to LD4 are connected to ground in common. Each of LED elements LD1 to LD4 cast light on surface of a photosensitive drum, according to drive currents I1 to I4 given from transistors TR1 to TR4 in said LED head 3, so as to form a dot image comprising dot D or dot d on main line or on sub-line of said print sheet 100.

Figure 4:
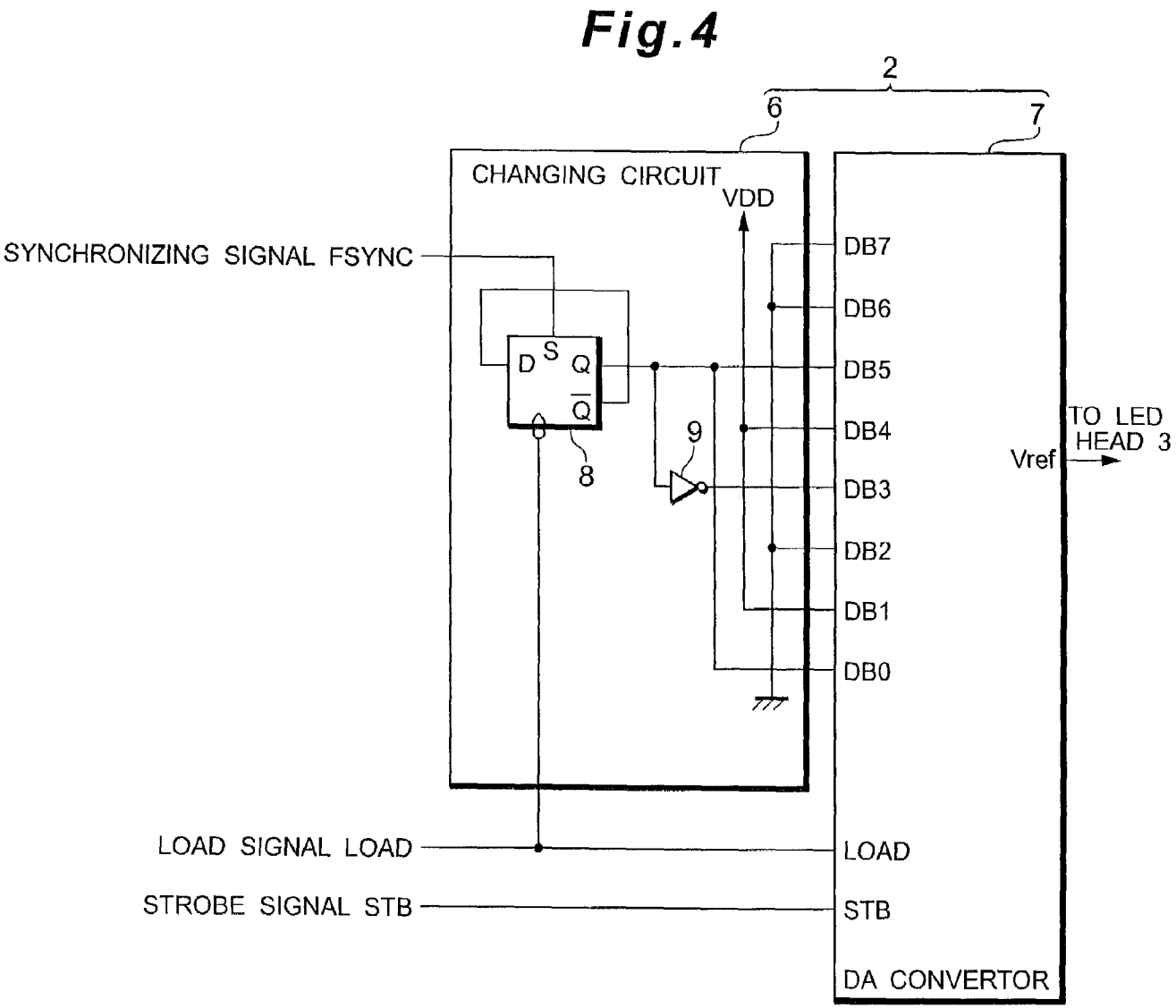
FIG. 4 is a circuit diagram showing a structure of a correcting circuit.

FIG. 4 is a circuit diagram showing an example of configuration of a correcting circuit. The correcting circuit 2 comprises a changing circuit 6 and a DA convertor 7. The changing circuit 6 has a function of changing light emission according as a line to print is main line M or sub-line S. The DA convertor 7 has a function of generating said reference voltage Vref of analog voltage corresponding to a digital value inputted according to a result of the changing circuit 6. Thus, the correcting circuit 2 generates a reference voltage Vref by using said synchronizing signal FSYNC, said load signal LOAD and said strobe signal STB, as mentioned before. Then, the reference voltage Vref is used in the current varying circuits C1 to C4 on the driver IC chip 4 in said LED head 3.

The changing circuit 6 comprises a changing signal selecting circuit 8 and an inverter circuit 9, so as to change digital values given to said DA convertor 7 according as a line to print is a main line M or a sub-line S shown in FIG. 2.

The changing signal selecting circuit 8 is inputted with said synchronizing signal FSYNC at a set terminal S, with said load signal LOAD at a clock terminal and with an output signal of a inverse output terminal at an input terminal D. Thus, the changing signal selecting circuit 8 comprises a toggle flip-flop hitherto known well. And, the changing signal selecting circuit 8 puts out signals of two kinds, that is, a signal for a main line M and a signal for sub-line S, alternately from a non-inverse output terminal Q, at a timing decided by the load signal LOAD.

Said output signal put out from the non-inverse output signal Q of the changing signal selecting circuit 8 is inputted directly to input terminals DB5 and DB0 among input terminals DB7 to DB0 of the DA convertor 7. On the other hand, an output signal inverted by said inverter circuit 7, is inputted to an input terminal DB3. Among rest of input terminals, input terminals DB4 and DB1 is inputted with voltage Vdd of an electricity source. On the other hand, input terminals DB7, DB6 and DB2 are connected to ground. Since said input terminals are connected as mentioned above, when said main line M is going to be printed, that is, when output signal of non-inverse output terminal Q of said changing signal selecting circuit 8 is "1", the DA convertor is inputted with a digital value "00110011" corresponding to "33h" (h represents a hexadecimal). On the other hand, when said sub-line S is going to be printed, that is, when output signal of non-inverse output terminal Q of said changing signal selecting circuit 8 is "0", the DA convertor is inputted with a digital value "00011010" corresponding to "1Ah".

DA convertor 7 has a function of latch hitherto known well. This is a function of latching a digital value inputted to said input terminals DB7 to DB0, in the DA convertor 7. Therefore, it is not necessary to synchronize a time of inputting a digital value to the input terminals DB7 to DB0; with the output of DA convertor 7, that is, a time of changing said reference voltage Vref. That is, it becomes possible to control both times independently. Moreover, the DA convertor 7 is inputted with said load signal LOAD at LOAD terminal, and said strobe signal STB at STB terminal. Said function of latch is performed according to a timing decided by the strobe signal STB. And, an output of an analog value of said reference voltage Vref is performed according to a timing decided by the load signal LOAD.

<Operation>

Figure 5:
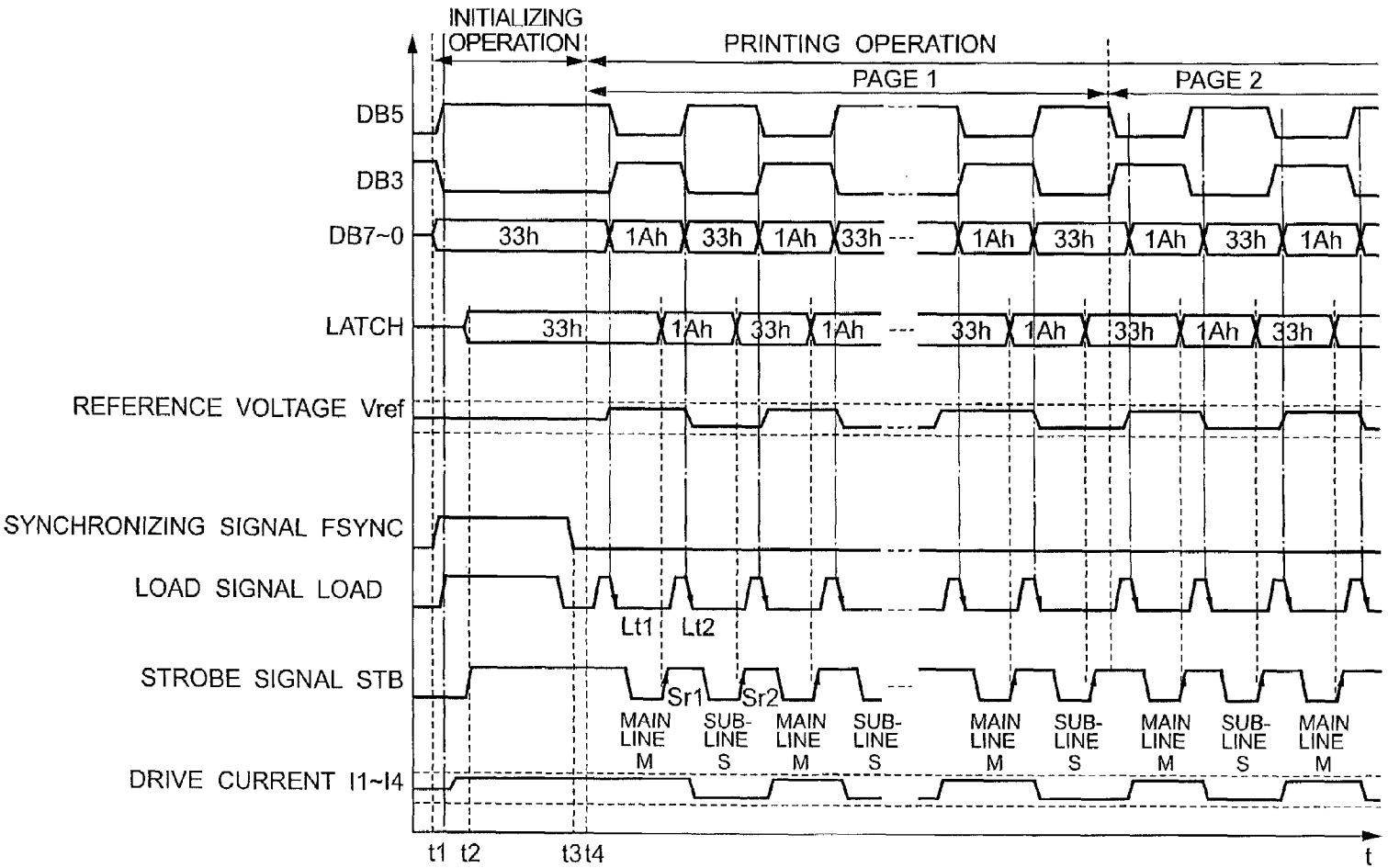
FIG. 5 is a time chart showing a printing operation of Embodiment 1.

FIG. 5 is a time chart showing a printing operation of Embodiment 1. Hereafter, operation of Embodiment 1 will be described referring to FIG. 5.

(Initializing Operation)

When power switch of the printer 200 turned on at time t1, the printer 200 performs an initializing operation. Then, the synchronizing signal FSYNC goes up from low level to high level. At this timing, the changing signal selecting circuit 8 in the changing circuit 6 is reset. Then, DB5 of DA convertor 7 inputted with an output Q of the changing signal selecting circuit 8, goes up to high level. On the other hand, DB3 of DA convertor 7 inputted with an output Q of the changing signal selecting circuit 8 via inverter 9, goes down to low level. Thereby, DB7 to DB0 of DA convertor 7 is inputted with a digital value "00110011"="33h".

When the strobe signal STB goes up to high level at time t2, "33h" is latched in the DA convertor 7.

When the synchronizing signal FSYNC goes down to low level at time t3, the initializing operation ends.

(Printing Operation for Main Line M)

After the initializing operation ended, a printing operation starts at time t4. When said load signal LOAD inputted from said print control section 1, changes from high level to low level at time Lt1; the changing circuit 6 puts out the reference voltage Vref="33h" latched in the DA convertor 7, to the current varying circuit C1 to C4 in the LED head 3. Thereby, the current varying circuit C1 to C4 completes preparation for putting out drive currents I1 to I4 for main line M.

At the same time Lt1, the changing circuit 6 changes the digital value to be inputted to the input terminals DB7 to DB0, from "33h" to "1Ah".

While the strobe signal STB is low level, the LED head 3 puts out drive currents I1 to I4 to LED elements LD1 to LD4, so as to form dot D of a main line. That is, in the driver IC chip 4 of the LED head 3 (c.f. FIG. 3), the current varying circuits C1 to C4 accept signals D1 to D4 deciding time for following currents, decided by a NAND logic between the print data DATA latched in the latch circuits LT1 to LT4 and the strobe signal STB inverted by the inverter G0. And, according to signals D1 to D4 deciding time for following currents, drive currents I1 to I4 corresponding to said reference voltage Vref="33h" for said main line M, are put out to the LED elements LD1 to LD4 in said LED chip 5 via transistor TR1 to TR4, so as to form dot D of the main line M.

When the strobe signal STB goes up to high level from low level at time Sr1, to end printing of a main line M; DA convertor 7 in the correcting circuit 2 latches a digital value "00011010"="1Ah" for a sub-line S put out from the changing circuit 6 to the input terminals DB7 to DB0 of DA convertor 7, which has been changed from "33h" to "1Ah" at the same time Lt1 as the reference voltage Vref has been put out.

(Printing Operation for Sub-Line S)

After a printing operation for a main line M ended, a printing operation for sub-line S starts at time Lt2. When said load signal LOAD inputted from said print control section 1, changes from high level to low level at time Lt2; the changing circuit 6 puts out the reference voltage Vref="1Ah" latched in the DA convertor 7, to the current varying circuit C1 to C4 in the LED head 3. Thereby, the current varying circuit C1 to C4 completes preparation for putting out drive currents I1 to I4 for sub-line S.

At the same time Lt2, the changing circuit 6 changes the digital value to be inputted to the input terminals DB7 to DB0, from "1Ah" to "33h".

While the strobe signal STB is low level, the LED head 3 puts out drive currents I1 to I4 to LED elements LD1 to LD4, so as to form dot d of a sub-line S. That is, in the driver IC chip 4 of the LED head 3, the current varying circuits C1 to C4 accept signals D1 to D4 deciding time for following currents, decided by a NAND logic between the print data DATA latched in the latch circuit LT1 to LT4 and the strobe signal STB inverted by the inverter G0. And, according to signals D1 to D4 deciding time for following currents, drive currents I1 to I4 corresponding to said reference voltage Vref="1Ah" for said sub-line S, are put out to the LED elements LD1 to LD4 in said LED chip 5 via transistor TR1 to TR4, so as to form dot d of the sub-line S.

After a sub-line S was printed, another main line M and another sub-line are going to be printed, in the same process mentioned above. Thereby, main lines and sub-lines are printed alternatively. As a result, printing of a first page is performed. And, printing of a second page is performed.

<Effects>

As mentioned above, according to a printer of Embodiment 1; it becomes possible to perform a precise control of energy for emitting light from LED elements, because light quantity emitted from LED is decided by magnitude of drive currents I1 to I4.

Embodiment 2

<Configuration>

Subsequently, a printer of Embodiment 2 will be described. A printer of Embodiment 2 is different from a printer of Embodiment 1, in number of sub-lines S printed between neighboring main lines M. Therefore, its configuration and operation are different, according to the number of sub-lines S. Hereafter, chiefly described is difference of Embodiment 2 with Embodiment 1.

Figure 6:
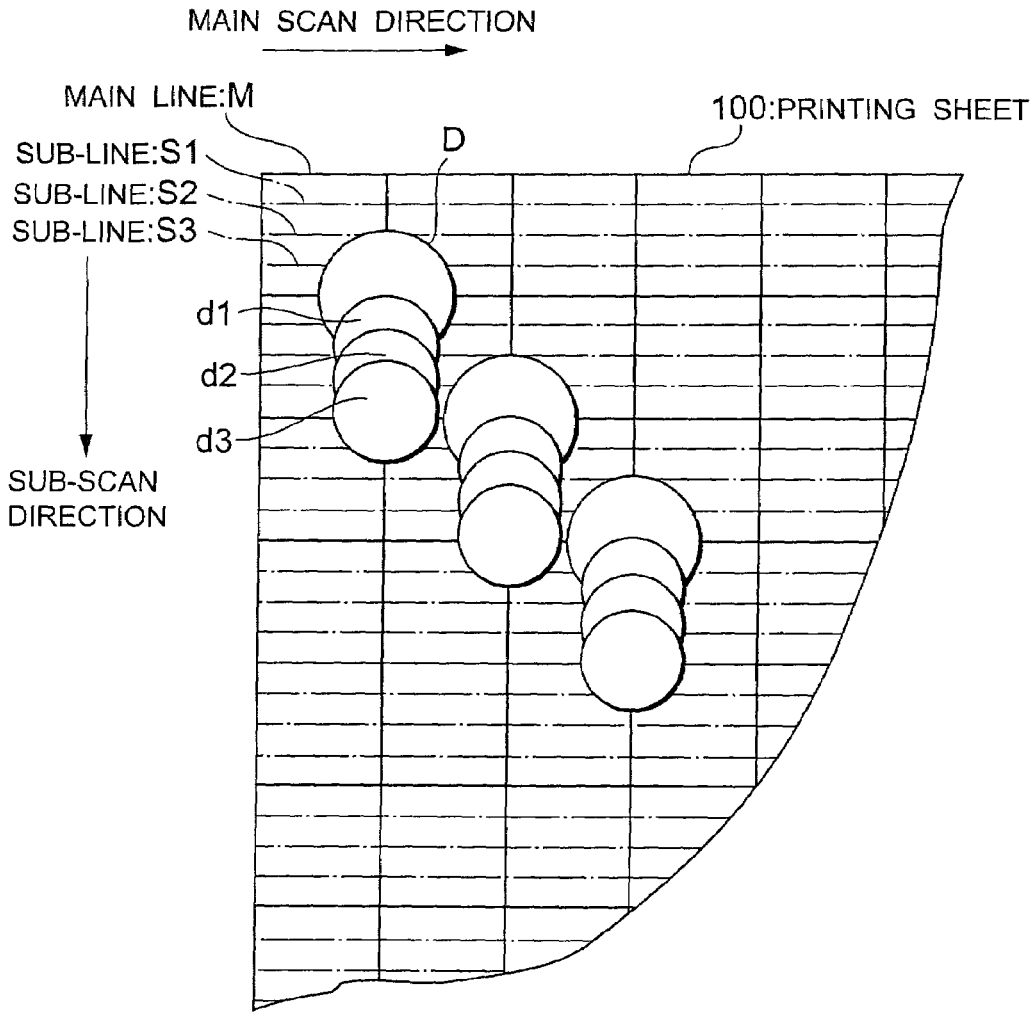
FIG. 6 is showing a part of a printed sheet with a slanted line smoothed by a method of Embodiment 2.

FIG. 6 is showing a part of a printed sheet with a slanted line smoothed by a method of Embodiment 2. As shown in FIG. 6, a printer of Embodiment 2 prints plural sub-lines S1, S2, S3 of three for an example. Here, dots d1, d2, d3 included in the plural sub-lines S1, S2, S3 are smaller than dots D on the main lines M. And, they are equivalent with each other.

A motor not shown in the drawings is provided as well as Embodiment 1, in order to send the printing sheet 100 to the LED elements along a sub-scan direction in FIG. 6, with each interval of a prescribed length per a unit time, under a control of a print control section 1 in FIG. 1. And, the LED elements arrayed in a main scan direction in FIG. 6 emit light at each main line M with a dot D and sub-lines S1, S2, S3 with dot d1, d2, d3.

Figure 7:
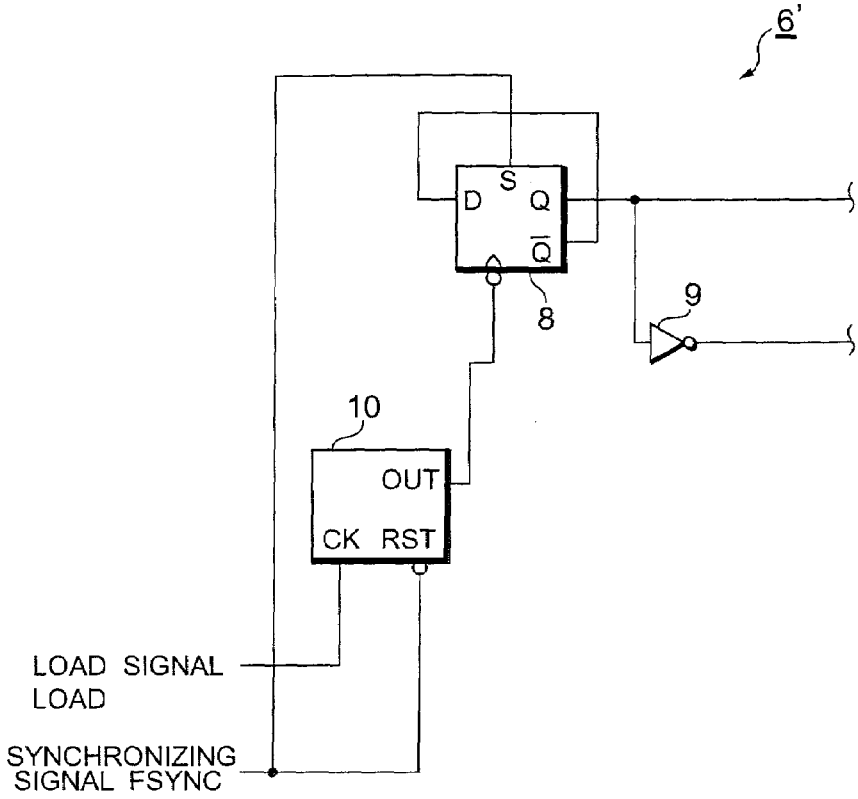
FIG. 7 is a circuit diagram showing a structure of a changing circuit of Embodiment 2.

FIG. 7 is a circuit diagram showing a structure of a changing circuit of Embodiment 2. As shown in FIG. 7, a changing circuit 6' of Embodiment 2 has a changing device 10 for supplying a main line M or sub-lines S1 to S3 shown in FIG. 6 selectively, in addition to a changing signal selecting circuit 8 and an inverter circuit 9 which are same as Embodiment 1.

As shown in FIG. 7, the changing device 10 is inputted with a load signal LOAD at a clock terminal CK and with a synchronizing signal FSYNC at a reset terminal RST. On the other hand, the changing device 10 puts out a changing signal from an output terminal OUT to a clock terminal of the changing signal selecting circuit 8, in order to change digital values inputted to a DA convertor 7.

<Operation>

Figure 8:
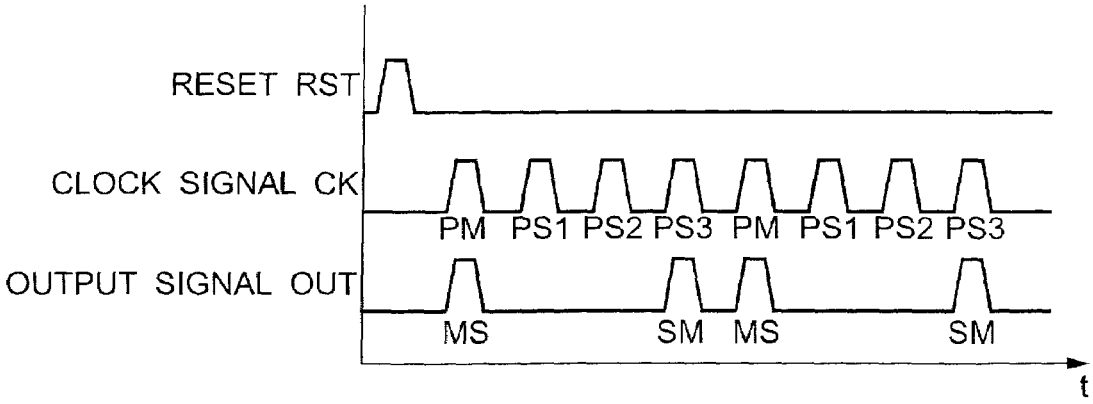
FIG. 8 is a time chart showing a changing operation.

FIG. 8 is a time chart showing an operation of the changing device 10. In FIG. 8, a pulse PM of the clock signal CK, that is, the load signal LOAD, represents a pulse used for printing the main line M. On the other hand, pulses PS1 to PS3 represent pulses used for printing the sub-lines S1 to S3. Moreover, in FIG. 8, the output signal OUT, that is, a pulse MS in the clock signal of the changing signal selecting circuit 8 represents a pulse deciding a time to change digital values inputted to input terminals DB7 to DB0 of the DA convertor 7, from a digital value "33h" for a main line M, a digital value "1Ah" for sub-lines S1 to S3. On the other hand, a pulse SM in the output signal OUT represents a pulse deciding a time to change digital values inputted to input terminals DB7 to DB0 of the DA convertor 7, from a digital value "1Ah" for sub-lines S1 to S3, a digital value "33h" for a main line M.

The changing device 10 starts operating after receiving a pulse of the reset signal RST, that is, the synchronizing signal FSYNC. The changing device 10 puts out the pulse MS to change from a main line M to a sub-line S1 according to a pulse PM which is a pulse of the clock signal CK of the number 4n+1. Here, n is each integer more than or equal to 0. For example, number 1, 5, 9 etc. On the other hand, the changing device 10 puts out the pulse SM to change from sub-line S3 to a main line M according to a pulse PS3 which is a pulse of the clock signal CK of the number 4n. Here, n is each integer more than 0. For example, number 4, 8, 12 etc.

When the output signal OUT mentioned above is received from the changing device 10, the changing signal selecting circuit 8, according to the output signal OUT, puts out a digital value "33h" for a main line M or a digital value "1Ah" for sub-lines S1 to S3, to input terminals DB7 to DB0 as well as Embodiment 1.

Figure 9:
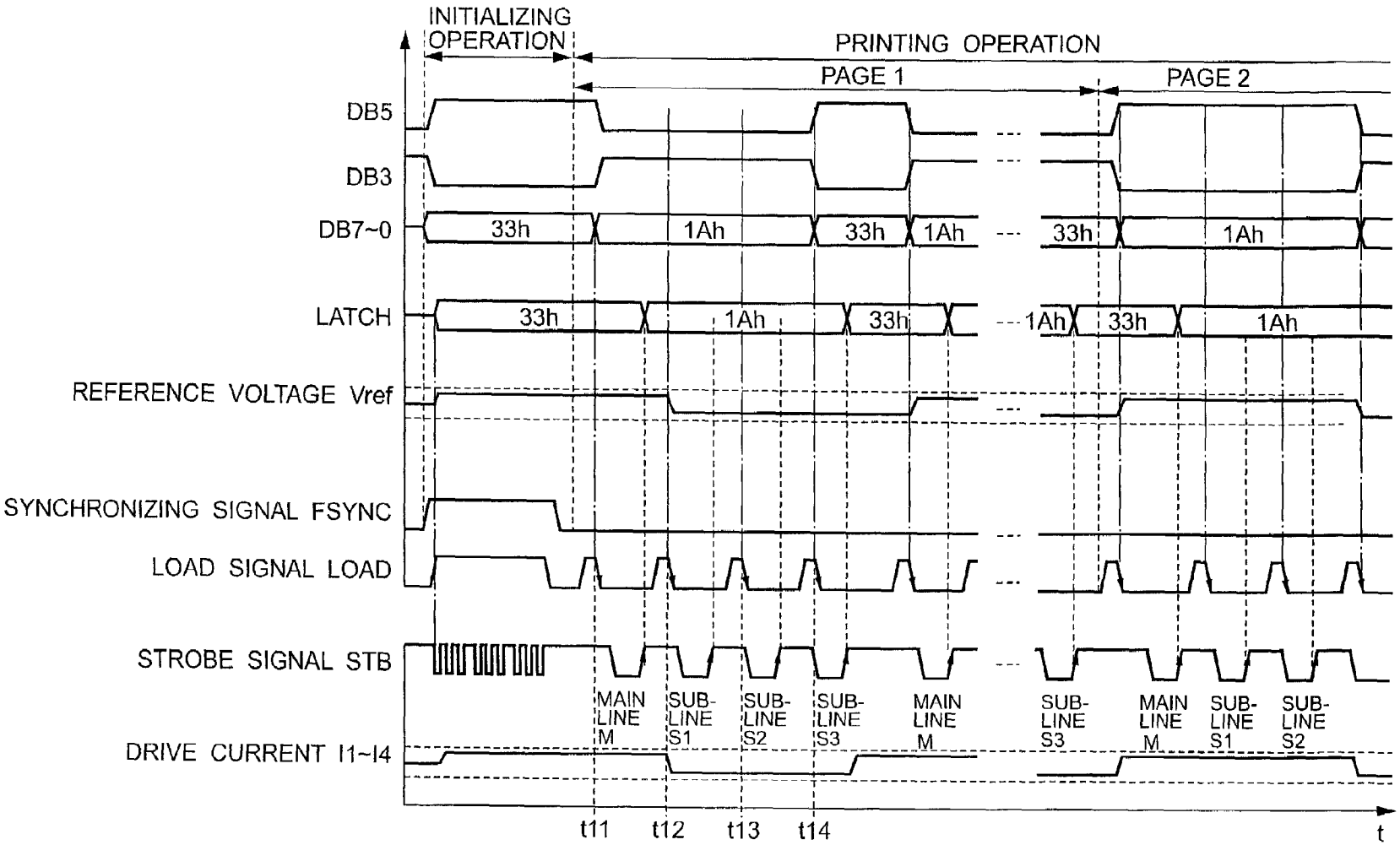
FIG. 9 is a time chart showing a printing operation of Embodiment 2.

FIG. 9 is a time chart showing an operation of a printer of Embodiment 2. An operation of a printer of Embodiment 2 is similar to Embodiment 1. Therefore, chiefly described are differences between both of them, referring to this time chart.

At an initializing operation, DB7 to DB0 of DA convertor 7 is inputted with a digital value "00110011"="33h", and "33h" is latched in the DA convertor 7 as same as Embodiment 1.

(Printing Operation for Main Line M)

After the initializing operation ended, a printing operation starts. When said load signal LOAD inputted from said print control section 1, changes from high level to low level at time t11; the changing circuit 6' puts out the reference voltage Vref="33h" latched in the DA convertor 7, to the current varying circuit C1 to C4 in the LED head 3. Thereby, the current varying circuit C1 to C4 completes preparation for putting out drive currents I1 to I4 for main line M.

At the same time t11, the changing circuit 6' changes the digital value to be inputted to the input terminals DB7 to DB0, from "33h" to "1Ah"; because the load signal LOAD of FIG. 7, that is, the clock signal CK of FIG. 8 is corresponding to a pulse PM, and the output signal OUT is put out to the DA convertor 7 as a pulse MS of FIG. 8.

While the strobe signal STB is low level, the LED head 3 puts out drive currents I1 to I4 to LED elements LD1 to LD4, so as to form dot D of a main line M.

When the strobe signal STB goes up to high level from low level, to end printing of a main line M; DA convertor 7 in the correcting circuit 2 latches a digital value "00011010"="1Ah" for sub-lines S1 to S3 put out from the changing circuit 6' to the input terminals DB7 to DB0 of DA convertor 7.

(Printing Operation for Sub-line S)

After a printing operation for a main line M ended, a printing operation for sub-line S1 starts at time t12. When said load signal LOAD inputted from said print control section 1, changes from high level to low level at time t12; the changing circuit 6' puts out the reference voltage Vref="1Ah" latched in the DA convertor 7, to the current varying circuit C1 to C4 in the LED head 3. Thereby, the current varying circuit C1 to C4 completes preparation for putting out drive currents I1 to I4 for sub-line S1.

Here, at time t12, the changing circuit 6' does not change the digital value to be inputted to the input terminals DB7 to DB0, so as to keep "1Ah", unlike Embodiment 1; because the load signal LOAD of FIG. 7, that is, the clock signal CK of FIG. 8 is corresponding to a pulse PS1, and the output signal OUT is not put out to the DA convertor 7.

While the strobe signal STB is low level, the LED head 3 puts out drive currents I1 to I4 to LED elements LD1 to LD4, so as to form dot d of a sub-line S1.

After a sub-line S1 was printed, another sub-line S2 is going to be printed from at time t13. When said load signal LOAD inputted from said print control section 1, changes from high level to low level at time t13; the changing circuit 6' puts out the reference voltage Vref="1Ah" latched in the DA convertor 7, to the current varying circuit C1 to C4 in the LED head 3. Thereby, the current varing circuit C1 to C4 completes preparation for putting out drive currents I1 to I4 for sub-line S2.

Here, at time t13, the changing circuit 6' does not change the digital value to be inputted to the input terminals DB7 to DB0, so as to keep "1Ah", unlike Embodiment 1; because the load signal LOAD of FIG. 7, that is, the clock signal CK is corresponding to a pulse PS2 of FIG. 8, and the output signal OUT is not put out to the DA convertor 7.

While the strobe signal STB is low level, the LED head 3 puts out drive currents I1 to I4 to LED elements LD1 to LD4, so as to form dot d of a sub-line S2.

After a sub-line S2 was printed, another sub-line S3 is going to be printed from at time t14. When said load signal LOAD inputted from said print control section 1, changes from high level to low level at time t14; the changing circuit 6' puts out the reference voltage Vref="1Ah" latched in the DA convertor 7, to the current varying circuit C1 to C4 in the LED head 3. Thereby, the current varying circuit C1 to C4 completes preparation for putting out drive currents I1 to I4 for sub-line S3.

Here, at time t14, the changing circuit 6' changes the digital value to be inputted to the input terminals DB7 to DB0, so as to change from "1Ah" to "33h", like Embodiment 1; because the load signal LOAD of FIG. 7, that is, the clock signal CK is corresponding to a pulse PS3 of FIG. 8, and the output signal OUT is put out to the DA convertor 7 as a pulse SM of FIG. 8. Then, preparation for another main line M is performed.

While the strobe signal STB is low level, the LED head 3 puts out drive currents I1 to I4 to LED elements LD1 to LD4, so as to form dot d of a sub-line S3.

After a sub-line S3 was printed, another main line M and other sub-lines S1 to S3 are going to be printed, in the same process mentioned above. Thereby, a main line and three sub-lines are printed alternatively. As a result, printing of a first page is performed. And, printing of a second page is performed.

<Effects>

As mentioned above, according to a printer of Embodiment 2; when a main line and plural sub-lines are printed, it becomes possible to perform a precise control of energy for emitting light from LED elements, because light quantity emitted from LED is decided by magnitude of drive currents I1 to I4.

OTHER EMBODIMENTS

The present is not limited to Embodiments mentioned above. That is, the present invention is able to be applied to printer control of the same kind. For example, the present invention is able to be applied to control of heating elements or driving elements of a thermal printer.

What is claimed is:

1. An image forming apparatus, comprising:

a print head that includes a plurality of driving elements for printing dots along main lines and sub-lines between the main lines, the driving elements being disposed in a row, and the main lines and sub-lines being disposed parallel to the row, a shifting section for shifting print data into the print head, a latching section for latching the shifted-in print data, and an actuating section, responsive to a strobe signal and a reference voltage, for actuating the driving elements in accordance with the print data latched by the latching section and for setting the magnitude of current supplied to the driving elements in accordance with the reference voltage, the actuating section including a plurality of actuating circuits, each of which is connected to a respective one of the driving elements; and a control section for controlling the reference voltage so that the current supplied to the driving elements is higher in magnitude when the driving elements print dots along the main lines than when the driving elements print dots along the sub-lines, wherein not more than three sub-lines are present between consecutive main lines, and wherein each of the actuating circuits comprises a transistor having a source, drain, and gate, the source of the transistor receiving a drive voltage and the drain of the transistor being connected to the respective one of the driving elements, a gate circuit having a first input terminal that is connected to the latching section and a second input terminal that receives the strobe signal, and a current varying circuit that receives an output signal of the gate circuit and the reference voltage, the current varying circuit having an output terminal that is connected to the gate of the transistor, the transistor and the current varying circuit cooperating to form a current mirror circuit that outputs a drive current to the respective one of the driving elements based on the reference voltage, the drive current being output to the respective one of the transistors during a period determined by the output signal of the gate circuit.

2. An image forming apparatus according to claim 1, wherein the control section comprises a print control section that emits the strobe signal to the print head, the strobe signal establishing a driving time for the driving elements, the driving time for printing dots along the main lines being substantially the same as the driving time for printing dots along the sub-lines.

3. An image forming apparatus according to claim 1, wherein the driving elements are light emitting elements.

4. An image forming apparatus according to claim 1, wherein the control section comprises a print control section that emits print data to the print head, the print data specifying where dots are to be printed on the main lines and the sub-lines.

5. An image forming apparatus according to claim 1, wherein the control section comprises:

a digital to analog converter having an output terminal that supplies the reference voltage; and a generating circuit for generating a digital input signal for the digital to analog converter, the generating circuit including a flip flop that receives load signal pulses and synchronizing signal pulses, the flip flop being toggled by the synchronizing signal pulses.

6. An image forming apparatus according to claim 1, wherein there are plural sub-lines between consecutive main lines.

7. An image forming apparatus according to claim 6, wherein the control section comprises:

a digital to analog converter having an output terminal that supplies the reference voltage;

a changing circuit that receives load signal pulses and synchronizing signal pulses, the changing circuit counting pulses of the synchronizing signal and outputting a pulse train having a first pulse every time a predetermined number of synchronizing pulses have been counted and having a second pulse preceding every first pulse; and a generating circuit for generating a digital input signal for the digital to analog converter, the generating circuit including a flip flop that receives the train of first and second pulses from the changing circuit.

8. An image forming apparatus according to claim 7, wherein the predetermined number is four, and there are three sub-lines between every pair of consecutive main lines.

9. An image forming apparatus for forming images on a medium moving in a media transport direction, comprising:

an optical head that includes plural light emitting elements arrayed in a row that extends in a direction substantially perpendicular to the media transport direction, the light emitting elements producing dots of light along main lines and sub-lines that extend parallel to the row, a shifting section for shifting print data into the optical head, a latching section for latching the shifted-in print date, and an actuating section, responsive to a strobe signal and a reference voltage, for actuating the light emitting elements in accordance with the print data latched by the latching section and for setting the magnitude of current supplied to the light emitting elements in accordance with the reference voltage, the actuating section including a plurality of actuating circuits, each of which is connected to a respective one of the light emitting elements; and a control section for periodically changing the reference voltage provided to the optical head corresponding to the movement of said medium, wherein not more than three sub-lines are present between consecutive main lines, and wherein each of the actuating circuits comprises a transistor having a source, drain, and gate, the source of the transistor receiving a drive voltage and the drain of the transistor being connected to the respective one of the driving elements, a gate circuit having a first input terminal that is connected to the latching section and a second input terminal that receives the strobe signal, and a current varying circuit that receives an output signal of the gate circuit and the reference voltage, the current varying circuit having an output terminal that is connected to the gate of the transistor, the transistor and the current varying circuit cooperating to form a current mirror circuit that outputs a drive current to the respective one of the driving elements based on the reference voltage, the drive current being output to the respective one of the transistors during a period determined by the output signal of the gate circuit.

10. An image forming apparatus according to claim 9, wherein the sub-lines are disposed between the main lines; and wherein the control section changes the reference voltage periodically corresponding to said main lines and said sub-lines.

11. An image forming apparatus according to claim 9, wherein said medium is a photosensitive sheet.

12. An image forming apparatus according to claim 9, wherein the control section comprises:

a digital to analog converter having an output terminal that supplies the reference voltage; and a generating circuit for generating a digital input signal for the digital to analog converter, the generating circuit including a flip flop that receives load signal pulses and synchronizing signal pulses, the flip flop being toggled by the synchronizing signal pulses.

13. An image forming apparatus, comprising:

an optical head that includes a plurality of light emitting elements arrayed in a row, the light emitting elements producing dots of light along main lines and sub-lines that extend parallel to the row, a shifting section for shifting print data into the optical head, a latching section for latching the shifted-in print date, and an actuating section, responsive to a strobe signal and a reference voltage, for actuating the light emitting elements in accordance with the print data latched by the latching section and for setting the magnitude of current supplied to the light emitting elements in accordance with the reference voltage, the actuating section including a plurality of actuating circuits, each of which is connected to a respective one of the light emitting elements;

a control section for controlling printing by varying the reference voltage so as to form dots having smaller sizes along the sub-lines than along the main lines, wherein not more than three sub-lines are present between consecutive main lines, and wherein each of the actuating circuits comprises a transistor having a source, drain, and gate, the source of the transistor receiving a drive voltage and the drain of the transistor being connected to the respective one of the driving elements, a gate circuit having a first input terminal that is connected to the latching section and a second input terminal that receives the strobe signal, and a current varying circuit that receives an output signal of the gate circuit and the reference voltage, the current varying circuit having an output terminal that is connected to the gate of the transistor, the transistor and the current varying circuit cooperating to form a current mirror circuit that outputs a drive current to the respective one of the driving elements based on the reference voltage, the drive current being output to the respective one of the transistors during a period determined by the output signal of the gate circuit.

14. An image forming apparatus according to claim 13, wherein the image forming apparatus is an LED printer and wherein the light emitting elements are LED's.

15. An image forming apparatus according to claim 13, wherein a sub-line is disposed between each pair of adjacent main lines, and wherein the magnitude of the current for printing dots along the main lines is larger than the magnitude of the current for printing dots along the sub-lines.

16. An image forming apparatus according to claim 13, wherein the control section comprises:

a digital to analog converter having an output terminal that supplies the reference voltage; and a generating circuit for generating a digital input signal for the digital to analog converter, the generating circuit including a flip flop that receives load signal pulses and synchronizing signal pulses, the flip flop being toggled by the synchronizing signal pulses.

17. An image forming apparatus according to claim 13, wherein plural sub-lines are disposed between each pair of adjacent main lines, and wherein the magnitude of the current for printing dots along the main lines is larger than the magnitude of the current for printing dots along the sub-lines.

18. An image forming apparatus according to claim 17, wherein the control section comprises:

a digital to analog converter having an output terminal that supplies the reference voltage;

a changing circuit that receives load signal pulses and synchronizing signal pulses, the changing circuit counting pulses of the synchronizing signal and outputting a pulse train having a first pulse every time a predetermined number of synchronizing pulses have been counted and having a second pulse preceding every first pulse; and a generating circuit for generating a digital input signal for the digital to analog converter, the generating circuit including a flip flop that receives the train of first and second pulses from the changing circuit.

19. An image forming apparatus according to claim 18, wherein the predetermined number is four, and there are three sub-lines between every pair of consecutive main lines.

* * * * *